US006506453B2

(12) United States Patent
Ema et al.

(10) Patent No.: US 6,506,453 B2
(45) Date of Patent: Jan. 14, 2003

(54) DEPOSITION METHOD, DEPOSITION APPARATUS, AND PRESSURE-REDUCTION DRYING APPARATUS

(75) Inventors: Tatsuhiko Ema, Kawasaki (JP); Shinichi Ito, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/735,553

(22) Filed: Dec. 14, 2000

(65) Prior Publication Data

US 2001/0004467 A1 Jun. 21, 2001

(30) Foreign Application Priority Data

Dec. 15, 1999 (JP) ..... 11-356447

(51) Int. Cl.[7] ..... B05D 1/26; B05D 3/06; B05D 5/12

(52) U.S. Cl. ..... 427/424; 427/421; 427/420; 427/427; 427/58; 427/314; 427/320; 427/592; 427/256; 427/286; 427/318

(58) Field of Search ..... 427/240, 424, 427/425, 592, 58, 256, 286, 318, 420, 421, 427; 118/52, 320, 314

(56) References Cited

U.S. PATENT DOCUMENTS

| | | | | |
|---|---|---|---|---|
| 5,580,607 A | * | 12/1996 | Takekuma et al. | 118/52 |
| 5,902,399 A | * | 5/1999 | Courtenay | 118/321 |
| 5,932,009 A | * | 8/1999 | Kim et al. | 118/500 |
| 6,072,162 A | | 6/2000 | Ito et al. | |
| 6,162,745 A | * | 12/2000 | Ito et al. | 427/510 |
| 6,200,633 B1 | * | 3/2001 | Kitano et al. | 118/320 |
| 6,231,917 B1 | * | 5/2001 | Ito et al. | 427/117 |
| 6,317,642 B1 | * | 11/2001 | You et al. | 700/121 |
| 6,322,626 B1 | * | 11/2001 | Shirley | 118/101 |
| 6,410,080 B1 | * | 6/2002 | Ito | 427/420 |

FOREIGN PATENT DOCUMENTS

| | | |
|---|---|---|
| JP | 5-136042 | 6/1993 |
| JP | 2000-77326 | 3/2000 |

* cited by examiner

*Primary Examiner*—Shrive P. Beck
*Assistant Examiner*—Jennifer Kolb Michener
(74) *Attorney, Agent, or Firm*—Finnegan, Henderson, Farabow, Garrett & Dunner, L.L.P.

(57) ABSTRACT

Using a scan coating method, a liquid film is formed on a substrate having a temperature distribution for correcting a temperature distribution of a liquid film caused by the heat of evaporation due to the volatilization of a solvent contained in the liquid film, and then the solvent is removed from the liquid film to form a coating film.

12 Claims, 5 Drawing Sheets

DEPOSITION METHOD, DEPOSITION APPARATUS, AND PRESSURE-REDUCTION DRYING APPARATUS

CROSS-REFERENCE TO RELATED APPLICATIONS

This application is based upon and claims the benefit of priority from the prior Japanese Patent Application No. 11-356447, filed Dec. 15, 1999, the entire contents of which are incorporated herein by reference.

BACKGROUND OF THE INVENTION

This invention relates to a deposition method, a deposition apparatus, and a pressure-reduction drying apparatus for depositing a coating film on a substrate to be processed by supplying a liquid to the substrate and volatilizing a solvent from a liquid film.

Conventionally a spin coating method has been used widely in a deposition process using a liquid. Recently it has been the urgent necessity to develop a scan coating method for forming a liquid film all over the surface of a substrate by moving an ultrathin nozzle and a substrate relative to each other in a column direction and moving them relative to each other in a row direction except for the top of the substrate in order to reduce an amount of liquid used for environmental protection and prevent coating irregularities in a peripheral portion due to an increase in the size of a substrate.

A conventional scan coating method has the problem that the thickness of a coating film formed by the method is made extraordinarily greater than a target value in a coating starting portion in a scan pitch direction and gradually decreases in a coating ending portion.

BRIEF SUMMARY OF THE INVENTION

The object of the present invention is to provide a deposition method which is capable of uniforming the distribution of thicknesses of a coating film formed by a scan coating method.

In order to attain the above object, the present invention is constituted as follows.

(a) A deposition method comprises:

a liquid film forming step of dropping a liquid, which contains a solvent and solid matter added to the solvent, to a substrate to be processed from a dropping nozzle such that a fixed amount of liquid diffuses on the substrate, and moving the dropping nozzle and the substrate relative to each other with the dropped liquid remaining on the substrate, thereby to form a liquid film extending from a dropping starting point of the substrate to a dropping ending point thereof; and a step of removing the solvent from the liquid film to form a coating film, wherein, in the liquid film forming step, the substrate is heated or cooled to correct a temperature distribution of the liquid film caused by heat of evaporation due to volatilization of the solvent contained in the liquid film.

(b) A deposition method comprises:

a liquid film forming step of dropping a liquid, which contains a solvent and solid matter added to the solvent, to a substrate to be processed from a dropping nozzle such that a fixed amount of liquid diffuses on the substrate, and moving the dropping nozzle and the substrate relative to each other, with the dropped liquid remaining on the substrate, to drop the liquid from a dropping starting point of the substrate to a dropping ending point thereof, thereby to form a liquid film on the substrate; and a step of removing the solvent from the liquid film to form a coating film whose surface is flat, wherein, in the coating film forming step, the substrate is heated or cooled to correct a temperature distribution of the liquid film caused by heat of evaporation due to volatilization of the solvent contained in the liquid film.

The following are modes of operation which are favorable for the above two methods.

The substrate is heated or cooled such that a temperature of the dropping starting point of the substrate becomes higher than that of the dropping ending point thereof.

The substrate is heated or cooled such that an outer region of the substrate monotonously decreases in temperature from the dropping starting point to the dropping ending point and an inner region thereof is set at an almost fixed temperature, the almost fixed temperature being lower than a temperature of the dropping starting point and higher than that of the dropping ending point.

The substrate is heated or cooled so as to eliminate a temperature gradient of a region between the dropping starting point and the dropping starting point.

The substrate is heated or cooled such that a temperature gradient of the dropping ending point of the substrate becomes greater than that of the dropping starting point thereof.

The substrate is heated or cooled such that a temperature of both end portions of the substrate becomes lower than that of a central portion thereof.

The dropping starting point corresponds to a central portion of the substrate and the dropping ending point corresponds to end portions of the substrate; and the liquid film forming step comprises a step of dropping a liquid from the central portion of the substrate to one of the end portions thereof and a step of dropping a liquid from the central portion to other of the end portions.

The liquid is one of a resist film agent, an antireflective film agent, a low dielectric film agent, and a ferroelectric film agent.

(c) A deposition apparatus comprises:

a dropping nozzle for supplying a liquid to a substrate to be processed;

a driving section for moving the substrate and the dropping nozzle relative to each other; and a temperature controller on which the substrate is mounted, for providing a temperature distribution from a dropping starting point of the substrate to a dropping ending point thereof.

(d) A pressure-reduction drying apparatus comprising:

a temperature controller on which a substrate to be processed is mounted, for providing a temperature distribution from a liquid dropping starting point of the substrate to a liquid dropping ending point thereof; and a pressure-reducing chamber holding the substrate and the temperature controller and connected to a vacuum pump.

The following are modes of operation which are favorable for the above two apparatuses.

The temperature controller includes:

a heat absorbing section for absorbing heat and a heat generating section for generating heat, each of the heat absorbing section and the heat generating section being constituted of a plurality of plates whose temperatures are controlled independently; and a thermal diffusion plate provided on the heat absorbing section and the heat generating section.

The temperature controller includes:

a plurality of outer plates for independently controlling temperatures of a plurality of areas of an outer region of the substrate;

a central plate for controlling a temperature of a central region of the substrate;

a thermal diffusion plate provided on the outer plates and the central plate; and a gap adjustment table which is provided on the thermal diffusion plate and on which the substrate is mounted to form a gap between the thermal diffusion plate and the substrate.

The temperature controller includes:

a plurality of outer plates for independently controlling temperatures of a plurality of areas of an outer region of the substrate;

a thermal diffusion plate provided on the outer plates and a central plate; and a gap adjustment table which is provided on the thermal diffusion plate and on which the substrate is mounted to form a gap between the thermal diffusion plate and the substrate.

The above-described invention has the following advantages.

The nonuniformity of thickness of a film formed by volatilizing a solvent from a liquid film is caused by temperature profile due to the heat generated by the evaporation of the solvent after a liquid is dropped. The nonuniformity of thickness can be suppressed by forming a liquid film on the substrate having a temperature distribution for correcting the distribution of temperatures profile.

The nonuniformity can also be suppressed by making the temperature of a dropping starting point of the substrate higher than that of a dropping ending point thereof.

The nonuniformity can be suppressed more greatly by setting a temperature gradient of the dropping ending point greater than that of the dropping starting point.

Furthermore, the nonuniformity can be suppressed by eliminating a temperature gradient of a region between the dropping starting and ending points.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described with reference to the accompanying drawings.

First Embodiment

Figure 1A:
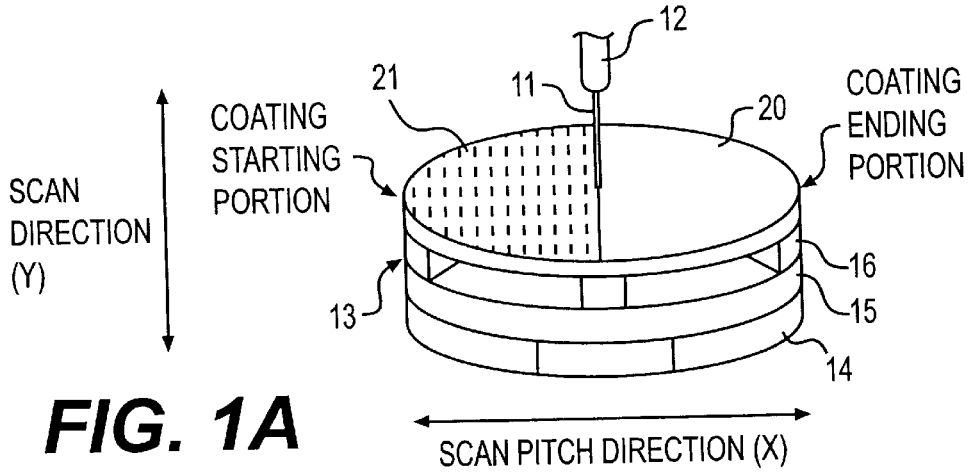
FIG. 1A is a perspective view schematically showing the structure of a coating apparatus according to a first embodiment of the present invention.
Figure 1B:
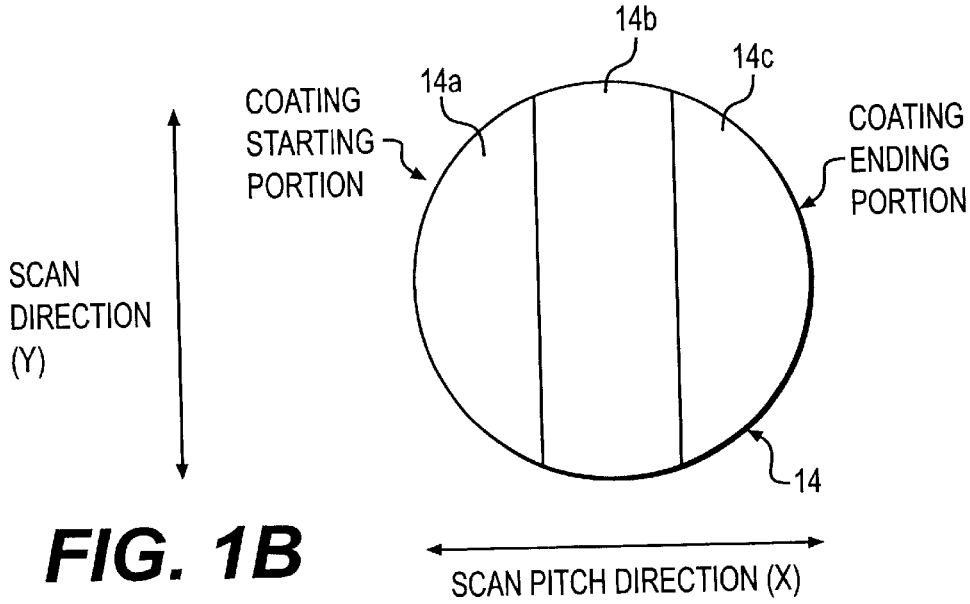
FIG. 1B is a plan view showing the structure of a hot plate according to the first embodiment of the present invention.

FIG. 1A is a perspective view of the structure of a coating apparatus and FIG. 1B is a plan view of the structure of a hot plate.

As FIG. 1A shows, the coating apparatus includes a liquid ejection nozzle 12 for dropping a liquid 11, which contains solid matter added to a solvent, to a substrate 20 to be processed and a temperature controller 13 on which the substrate 20 is mounted, for heating the substrate 20. The nozzle 12 has a 30-$\mu$m-diameter ejection port.

The liquid ejection nozzle 12 moves in a direction of y by means of a moving mechanism (not shown), while the substrate 20 moves in a direction of x by means of a moving mechanism (not shown) when the nozzle 12 is not located above the substrate 20. The nozzle 12 and the substrate 20 thus move relatively with each other. While the nozzle 12 and the substrate 20 are doing so, the nozzle 12 ejects the liquid 11 to form a liquid film 21 on the substrate 20.

The temperature controller 13 includes a plate 14, a thermal diffusion plate 15 mounted on the plate 14, and a gap adjustment table 16. As FIG. 1B shows, the plate 14 is equally divided into three sections in a scan pitch direction, the three sections being a first plate 14*a*, a second plate 14*b* and a third plate 14*c*. These plates 14*a* to 14*c* can control temperatures independently and, in other words, they vary the distribution of in-plane temperatures of the substrate 20.

In order to provide the substrate 20 with a thermal gradient smoothly and uniformly, the thermal diffusion plate 15 covers the top surface of the plate 14, the gap adjustment table 16 is placed on the plate 15, and the substrate 20 is mounted on the table 16.

Holding the generated heat, absorbed heat or temperatures, the plates 14*a* to 14*c* control the temperatures of a coating starting portion, a central portion, and a coating ending portion of the substrate 20.

Forming a resist film on the substrate by the coating apparatus described above will now be described.

Figure 2:
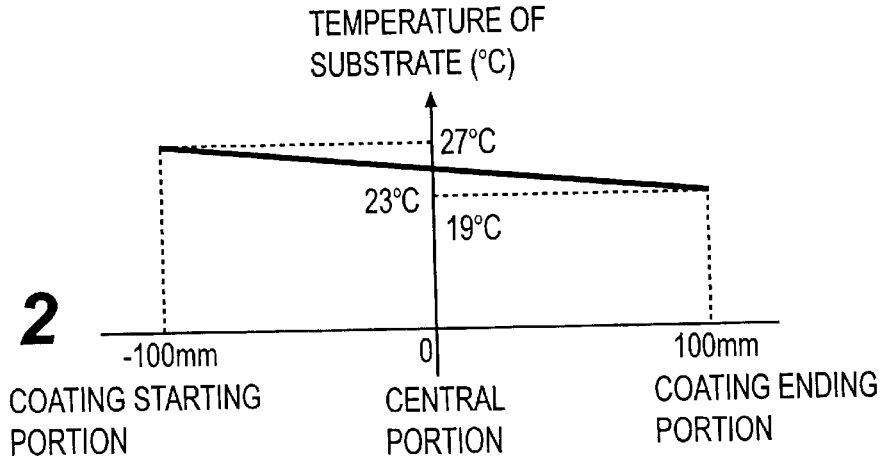
FIG. 2 is a diagram of the temperature distribution of substrates to be processed in a scan pitch direction according to the first embodiment of the present invention.

By varying the temperatures of the first to third plates 14*a* to 14*c*, as shown in FIG. 2, the coating starting portion, the central portion, and the coating ending portion of the substrate 20 are set to 27° C., 23° C. and 19° C., respectively, and the distribution of temperatures of the substrate 20 has a fixed gradient of 0.04° C./mm in the scan pitch direction of the liquid ejection nozzle 12.

As an amount of generated heat increases from the third plate 14*c*, followed by the second plate 14*b* and the first plate 14*a* in that order, the temperature of the substrate 20 decreases from the coating starting portion to the coating ending portion. Since the first plate 14*a* generates heat and the third plate 14*c* absorbs heat, the temperature lowers from the coating starting portion to the coating ending portion. As an amount of absorbed heat increases from the first plate 14*a*, followed by the second plate 14*b* and the third plate 14*c* in that order, the temperature of the substrate 20 decreases from the coating starting portion to the coating ending portion.

The liquid ejection nozzle 12 moves at the rate of 2 m/s in the y-direction (scan direction) on the substrate 20, while the substrate 20 moves with 0.3-mm pitch in the x-direction (scan pitch direction). The liquid (resist agent) 11 is then linearly dropped to the substrate 20 to form a resist liquid film (simply a liquid film) 21 on the entire surface of the substrate 20.

Next, the resist liquid film 21 undergoes a pressure-reduction drying process. First the substrate 20 is put into a chamber to which a vacuum pump is connected, and then the chamber is pressure-reduced at a pressure-reducing rate of $20.6664\times10^2$ Pa/sec (=20 Torr/sec) until its pressure reaches the same pressure (approximately $1.33322\times10^2$ Pa/sec [=1 Torr] in this embodiment) as the vapor pressure of a solvent contained in the resist liquid film. The reduced pressure is maintained for seventy seconds and the solvent in the liquid film is dried. After that, the pressure of the chamber returns to atmospheric pressure at a pressure rate of $53.2388\times10^2$ Pa/sec (=40 Torr/sec), and the substrate 20 is taken out of the chamber. Then, the substrate 20 is placed on the hot plate of 140° C. and subjected to a baking process for sixty seconds, thereby stabilizing the finally-formed resist film.

Furthermore, a resist film is formed on a substrate by the same process as described above after a liquid film is formed on the substrate using a scan coating method, without providing the distribution of temperatures within the surface of the substrate.

Figure 3:
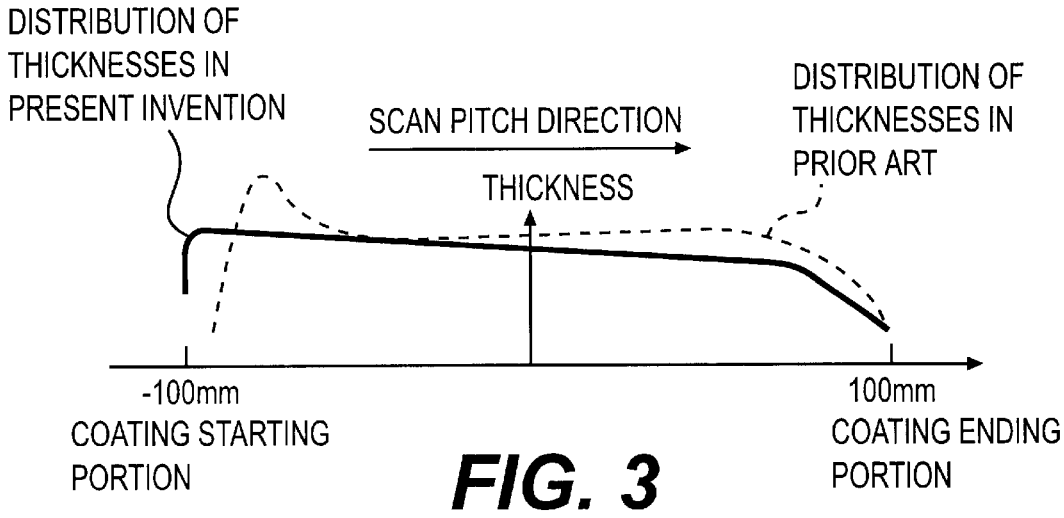
FIG. 3 is a diagram of the thickness distribution of resist films in the scan pitch direction according to the first embodiment of the present invention.

The thickness of the resist film formed by the above process was measured by a film-thickness measuring instrument. As a result of the measurement, the distribution of film thicknesses in the scan pitch direction is shown in FIG. 3. As is apparent from FIG. 3, the uniformity of film thickness was improved to 25 nm from 50 nm by employing the present process in which the temperature decreases from the coating starting portion to the coating ending portion.

The following is the reason why the uniformity of film thickness was improved by providing the substrate to be processed with a temperature gradient.

If a film is formed by the conventional scan coating method, a coating starting portion increases in thickness more greatly than a target film, whereas a coating ending portion gradually decreases in thickness. This thickness irregularities extend about 20 mm from an end portion of the substrate to be processed. The inventors of the present invention found that the coating starting and ending portions were asymmetrical because the heat of evaporation of a solvent caused a temperature difference in the scan pitch direction within the substrate during the scan coating.

A leaving time period required until a pressure-reduction drying process is performed in the coating starting portion is longer than that in the coating ending portion, and a large amount of heat is lost by the evaporation of a solvent during the period; accordingly, the resist liquid film tends to decrease in temperature. If such a temperature difference occurs within the surface of the substrate, the resist liquid film flows from a high-temperature portion to a low-temperature one and consequently the coating starting portion increases in thickness and the coating ending portion gradually decreases in thickness.

According to the first embodiment described above, in order to correct the distribution of temperatures caused by the heat of evaporation, a temperature distribution is uniformly applied in the scan pitch direction from outside; therefore, a resist liquid film can properly be prevented from flowing on the entire surface of the substrate to suppress the thickness irregularities of end portions of the substrate.

Second Embodiment

In the first embodiment, an increase of thickness of coating starting portion of a coating film can be removed, but a coating ending portion cannot be prevented from decreasing in thickness or a central portion cannot be prevented from inclining. In the second embodiment, a method of preventing a coating ending portion from decreasing in thickness and preventing a central portion from inclining will be discussed. More specifically, a reduction in the thickness of the coating ending portion can be suppressed by making a temperature gradient of the coating ending portion greater than that of the coating ending portion and then eliminating incline in temperatures in the central portion.

Figure 4A:
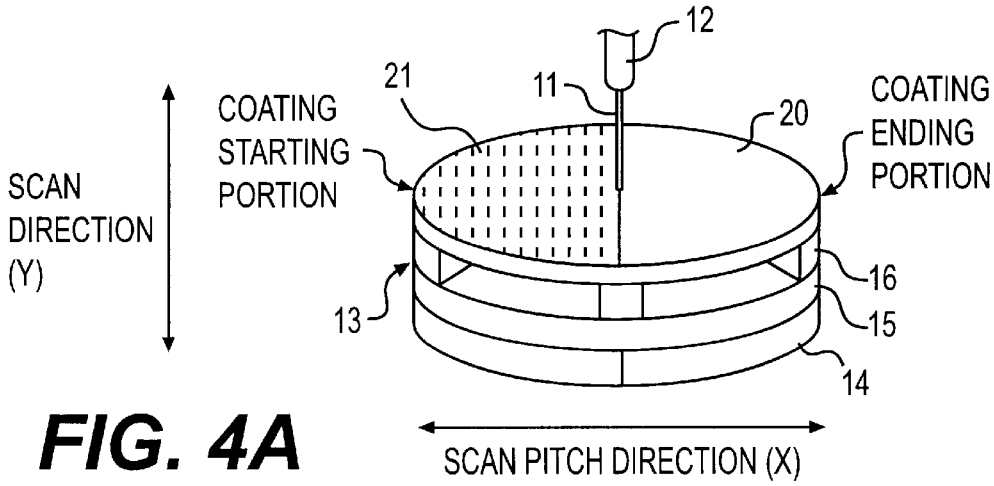
FIG. 4A is a perspective view showing the structure of a coating apparatus according to a second embodiment of the present invention.
Figure 4B:
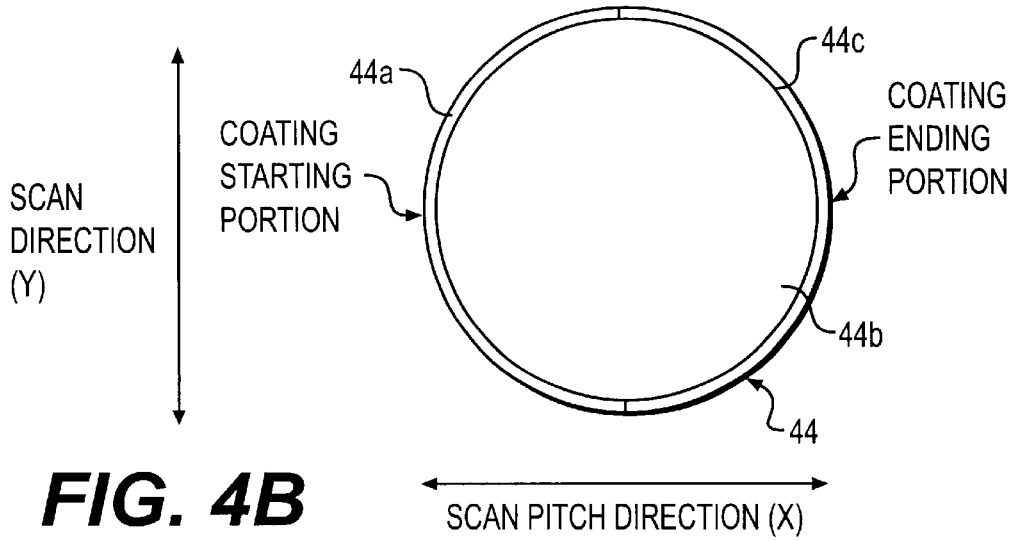
FIG. 4B is a plan view showing the structure of a plate according to the second embodiment of the present invention.

An apparatus for actually forming a coating film and a deposition method using the apparatus will now be described. FIG. 4A is a perspective view of the structure of a coating apparatus according to the second embodiment of the present invention, and FIG. 4B is a plan view of the structure of a plate. In these figures, the same constituting elements as those of FIGS. 1A and 1B are indicated by the same reference numerals and their detailed descriptions are omitted.

As FIG. 4B shows, the plate 44 includes a circular plate 44*b* for heating a central portion of a subject 20 to be processed and two semicircular plates 44*a* and 44*c* surrounding the circular plate 44*b*.

In order to provide the substrate 20 with a smooth, uniform thermal gradient, a thermal diffusion plate 15 covers the top surface of the plate 44, a gap adjustment table 16 is placed on the plate 15, and the substrate 20 is mounted on the table 16.

Figure 5:
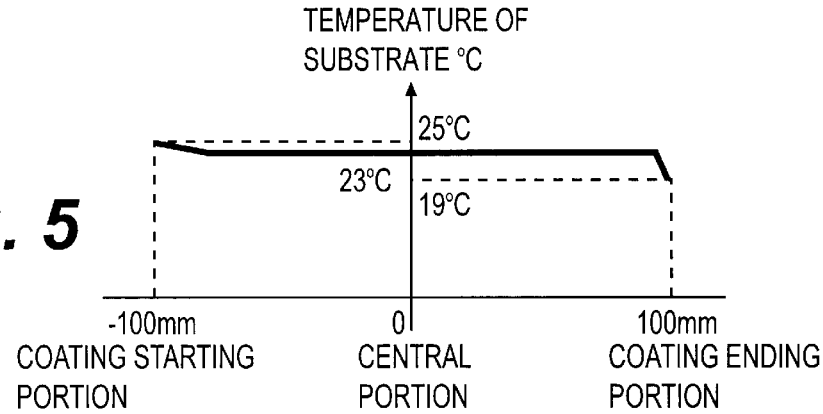
FIG. 5 is a diagram of the temperature distribution of substrates to be processed in a scan pitch direction according to the second embodiment of the present invention.

The deposition method using the coating apparatus will now be explained. The temperatures of the plates 44*a*, 44*b* and 44*c* are so controlled that the temperature gradient of the coating ending portion of the substrate 20 becomes greater than that of the coating starting portion thereof. For example, as shown in FIG. 5, the temperature of the coating starting portion is set at 25° C. and that of a region containing the central portion is set at 23° C. with a temperature gradient of −0.4° C./mm. The temperature of the coating ending portion decreases to 19° C. from 23° C. of the region with a temperature gradient of −0.8° C./mm.

Like in the first embodiment, a liquid ejection nozzle 12 moves at the rate of 2 m/s, while the substrate 20 moves with 0.3-mm pitch. A resist is then linearly dropped onto the substrate 20 to form a resist liquid film on the entire surface of the substrate 20. After that, the same pressure-reduction drying process as that of the first embodiment is performed to form a resist film.

Figure 6:
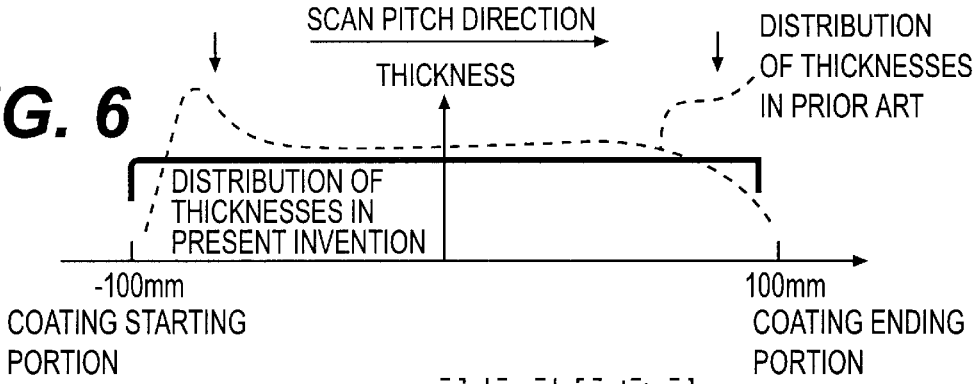
FIG. 6 is a diagram of the thickness distribution of resist films in the scan pitch direction according to the second embodiment of the present invention.

The thickness of the resist film obtained by the foregoing process was measured by a film-thickness measuring instrument. As a result of the measurement, FIG. 6 shows the distribution of film thicknesses in the scan pitch direction. FIG. 6 also shows the distribution of thicknesses of a resist film formed by the conventional process.

As FIG. 6 shows, the thickness uniformity of the resist film formed by the conventional process is 50 nm. It can be improved to 5 nm using the process of the second embodiment in which the substrate decreases in temperature from the coating starting portion to the coating ending portion by setting a temperature gradient of the ending portion greater than that of the starting portion in the temperature distribution ranging from the coating starting portion (high temperature) to the coating ending portion (low temperature).

In the first embodiment, the temperature distribution is uniformed in the scan pitch direction to properly prevent the resist film from moving on the entire surface of the substrate and suppress thickness irregularities of end portions of the substrate. However, only the coating starting portion is improved in thickness uniformity, whereas in the coating ending portion the resist liquid film does not flow and the thickness distribution is not improved so greatly. In the central portion of the substrate, the film thickness varies evenly with a temperature gradient. Though the temperature gradients are the same, the thickness uniformity is improved on the high-temperature side and not on the low-temperature side. The reason can be considered as follows. The absolute temperature is low on the low-temperature side and thus the resist liquid film hardly moves thereon. To move the resist liquid film on the low-temperature side, the temperature gradient of the central portion has to be eliminated. Thus, the thickness uniformity can be improved by making the temperature gradient of the coating starting portion equal to that in the first embodiment, eliminating that of the central portion, and setting that of the coating ending portion greater than that in the first embodiment.

Third Embodiment

Figure 7:
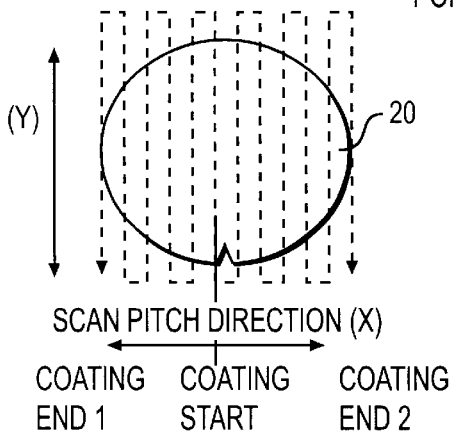
FIG. 7 is a view showing a method of coating a substrate with resist according to a third embodiment of the present invention.

In the first and second embodiments, using the scan coating method, an ultrathin nozzle (ϕ30 μm) reciprocates at the rate of 2 m/s in the y-direction on a substrate to be processed, while the substrate moves with 0.3-mm pitch in the x-direction, and a resist agent is linearly dropped in one direction from one end of the substrate to the other end thereof to form a liquid film on the entire surface of the substrate. The third embodiment is directed to a temperature distribution setting method. In this method, as illustrated in FIG. 7, a resist agent is dropped in a -x-direction from the central portion of the substrate to one end portion thereof and then it is dropped in a +x-direction from the central portion to another end portion thereby to form a liquid film on the entire surface of the substrate.

Figure 8:
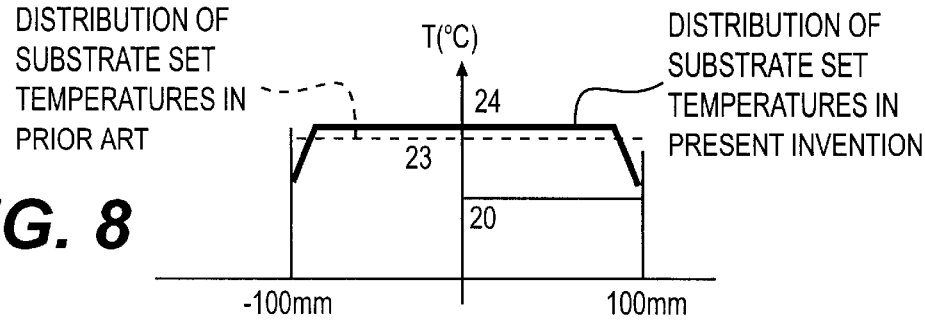
FIG. 8 is a diagram of the temperature distribution of substrates to be processed in a scan pitch direction according to the third embodiment of the present invention.

Since, in the third embodiment, dropping ending points are both ends of the substrate, the temperature of the central portion of the substrate slightly increases to 24° C. using the temperature controller 13 shown in FIG. 4A, and the temperature of each of the ends is set at 20° C. (−0.8° C./mm). The substrate is provided with the substrate setting temperature distribution shown in FIG. 8 and a resist agent is dropped thereto to form a liquid film on the entire surface of the substrate 20. In the conventional case where no temperatures are controlled (a fixed temperature of 23° C.), too, a resist agent is dropped to form a liquid film by the same method.

Next, the substrate 20 is put into a pressure-reducing chamber to which a vacuum pump is attached and then the chamber is pressure-reduced at a pressure-reducing rate of −266 Pa/sec until its pressure reaches the same pressure (approximately 133 Pa) as the vapor pressure of the resist agent. The reduced pressure is maintained for seventy seconds and the solvent in the liquid film is dried. After that, the pressure of the chamber is returned to atmospheric pressure at a pressure rate of +5320 Pa/sec, and the substrate 20 is taken out of the chamber. Then, the substrate 20 is held on a hot plate heated at 140° C. and subjected to a baking process for sixty seconds, thereby stabilizing the finally-formed resist film.

Figure 9:
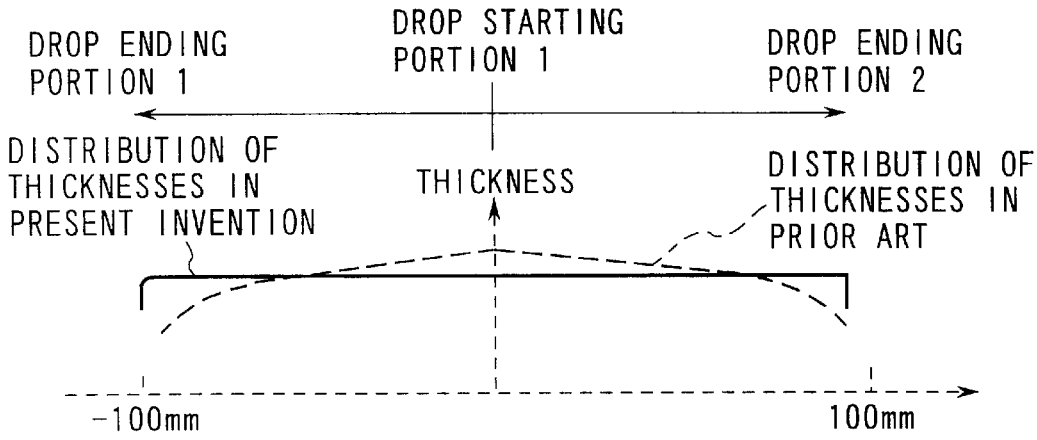
FIG. 9 is a diagram of the thickness distribution of resist films in the scan pitch direction according to the third embodiment of the present invention.

The thickness of the resist film obtained by the deposition method described above was measured. FIG. 9 shows the measured thickness. It is seen from FIG. 9 that, in the resist film formed by the conventional method without temperature control, both end portions of the substrate, which correspond to the dropping ending points, gradually decrease in thickness for the reason described above. The reason is that in the distribution of temperatures of the substrate caused by the evaporation of a solvent, the temperatures tend to decrease in the central portion of the substrate and increase in both end portions thereof.

In a resist film formed by applying the temperature distribution by the temperature controller so as to cancel a temperature distribution caused by the evaporation, the liquid is urged to flow at both ends of the substrate and thus the thickness uniformity is greatly improved. Consequently, the thickness uniformity can be improved from 30 nm to 5 nm in the third embodiment.

The resist dropping method of the present invention is not limited to that of the third embodiment. It is also effective in spirally dropping a resist agent from the central portion of the substrate to the peripheral portion thereof.

Fourth Embodiment

The fourth embodiment is directed to a deposition method and a deposition apparatus for forming a flat resist film by correcting the temperature distribution caused by the heat of evaporation of a solvent contained in a liquid film in a process of removing the solvent from the liquid film after the liquid film is formed on the substrate without correcting the temperature distribution.

Figure 10A:
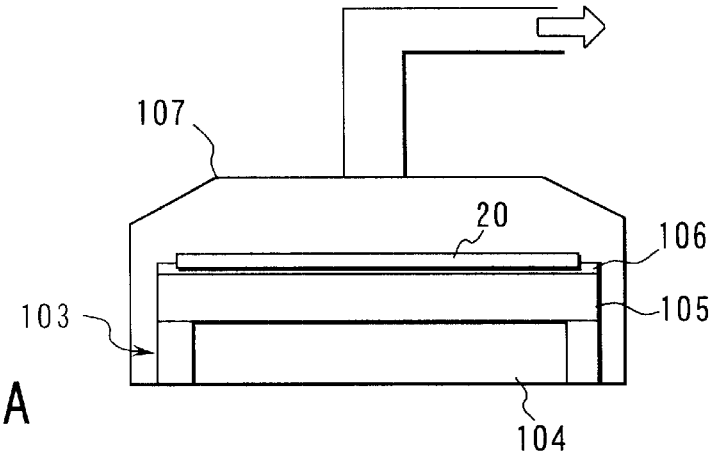
FIGS. 10A and 10B are views schematically showing the structure of a deposition apparatus according to a fourth embodiment of the present invention for removing a solvent.

A deposition apparatus for volatilizing a solvent in a liquid film will now be described. FIG. 10A is a perspective view schematically showing the structure of a coating apparatus according to a fourth embodiment of the present invention, and FIG. 10B is a plan view of the structure of a hot plate according to the fourth embodiment.

As FIG. 10A shows, the apparatus includes a pressure-reducing chamber 107 to which a vacuum pump (not shown) is connected and in which a substrate to be processed is placed, and a temperature controller 103 arranged in the chamber 107. The temperature controller 103 includes a plate 104, a thermal diffusion plate 105 mounted on the plate 104, and a gap adjustment table 106.

Figure 10B:
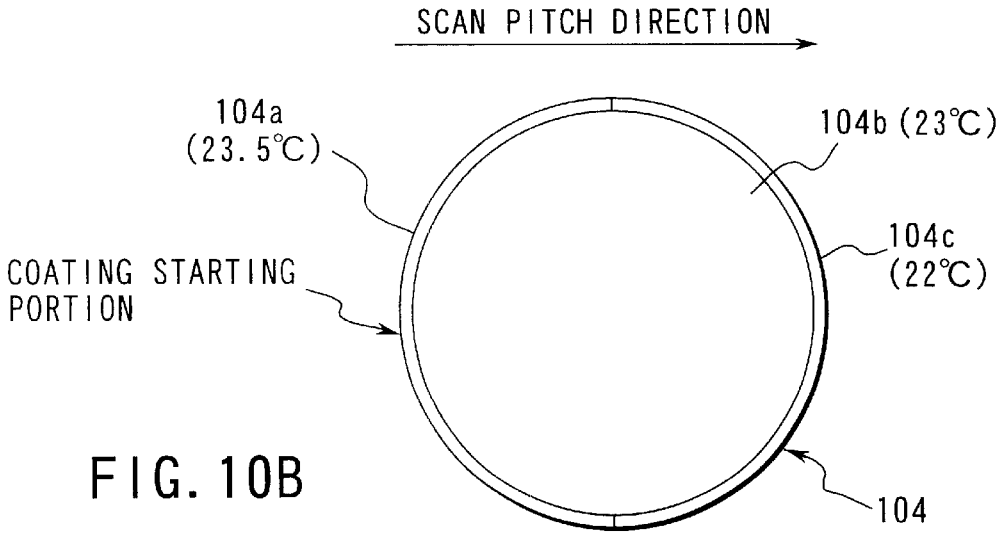

As FIG. 10B shows, the hot plate 104 includes a circular plate 104*b* for heating a central portion of a subject 20 to be processed and two semicircular plates 104*a* and 104*c* surrounding the circular plate 44*b*. These plates 104*a* to 104*c* can control temperatures independently and, in other words, they vary the distribution of in-plane temperatures of the substrate 20.

In order to provide the substrate 20 with a smooth, uniform thermal gradient, the thermal diffusion plate 105 covers the top surface of the plate 104, the gap adjustment table 106 is placed on the plate 105, and the substrate 20 is mounted on the table 106.

The deposition method in the fourth embodiment will now be described. First, an ultrathin nozzle (ϕ30 μm) reciprocates at speeds of 2 m/s in the y-direction on a substrate to be processed and the substrate 20 moves with 0.3-mm pitch in the x-direction, without correcting the temperature distribution caused by the heat of evaporation of the resist agent. The resist agent is dropped to a substrate 20 from the nozzle to form a liquid film on the substrate 20.

Figure 11:
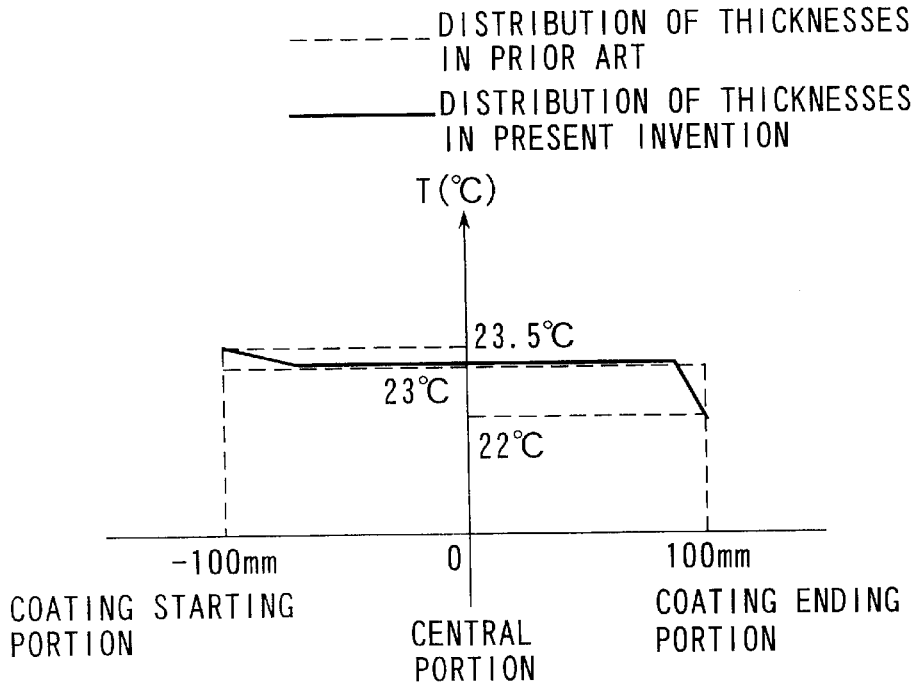
FIG. 11 is a diagram of the temperature distribution of substrates to be processed in a scan pitch direction according to the fourth embodiment of the present invention.

The substrate 20 on which the liquid film is formed is mounted on the gap adjustment table 106 in the pressure-reducing chamber 107. As FIG. 11 shows, a 5-mm coating starting portion (23.5° C.) of the substrate 20 is provided with a temperature gradient of −0.1° C./mm in the coating direction, the central portion is set at a fixed temperature of 23° C., and a 5-mm coating ending portion is provided with a temperature gradient of −0.2° C./mm. The chamber 107 is pressure-reduced at the rate of −266 Pa/sec until its pressure reaches almost the same pressure of 133 Pa as the vapor pressure of resist. The reduced pressure is maintained for seventy seconds and the solvent is eliminated from the liquid film. After that, the pressure of the chamber 107 is returned to atmospheric pressure at a pressure rate of +5320 Pa/sec, and the substrate 20 is taken out of the chamber 107.

The substrate 20 is placed on the hot plate of 140° C. and subjected to a baking process for sixty seconds, thereby stabilizing the finally-formed resist film.

Figure 12:
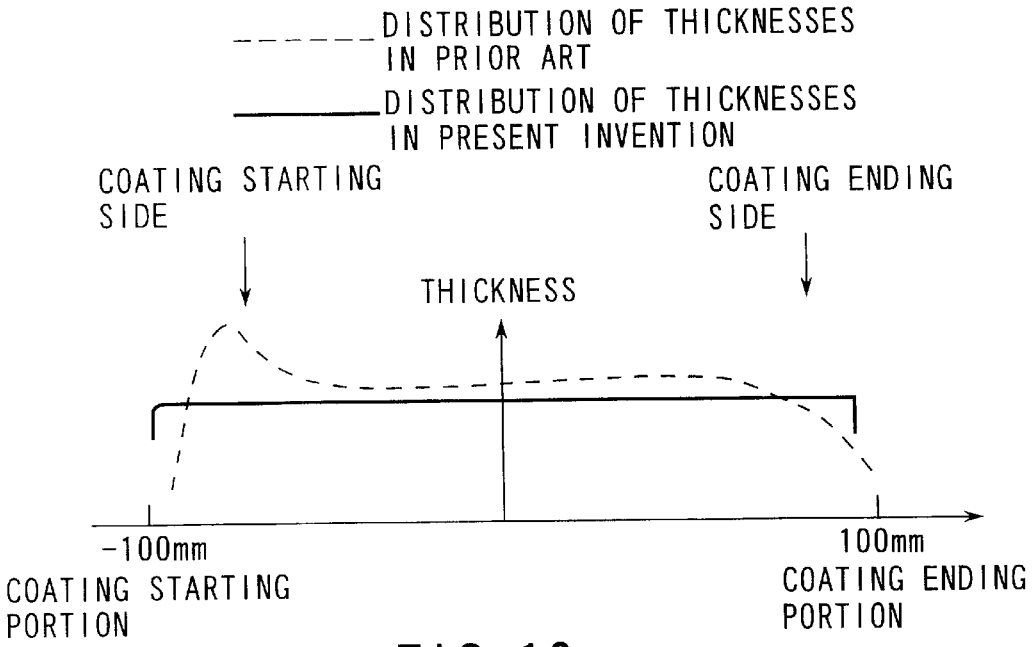
FIG. 12 is a diagram of the thickness distribution of resist films in the scan pitch direction according to the fourth embodiment of the present invention.

FIG. 12 shows the distribution of thicknesses of the resist film formed by the deposition method described above. For information, FIG. 12 also shows the distribution of thicknesses of a resist film formed without correcting or providing the temperature distribution caused by the heat of evaporation of a solvent in a liquid film forming step and a solvent moving step.

The thickness uniformity of the resist film, which does not undergo any correction of the temperature distribution, was 600 nm. If, however, the temperature distribution is corrected and the solvent is removed as in the fourth embodiment of the present invention, the thickness uniformity can greatly be improved to 4.5 nm.

In the fourth embodiment, the divided plate is not limited to the shape shown in FIG. 10B, but the plate shown in FIG. 1B can be used.

The present invention is not limited to the above embodiments. For example, the diameter of the liquid ejection nozzle is not limited to 30 μm, but it can properly be set in accordance with a liquid to be used and the thickness of a target film. The number of nozzles need not be limited to one. A plurality of nozzles can be prepared and, in this case, the nozzles can be arranged appropriately and an interval between them may corresponds to a chip interval.

The nozzle need not be shaped like a circle. For example, it can be replaced with a slit-type nozzle. The substrate to be processed moves in the scan pitch direction, but the nozzle itself can be moved in the scan pitch direction to perform a coating operation. The scanning rate is not limited to 2 m/sec. The relative movement of the nozzle and the substrate is not limited to the above embodiments. For example, they can be moved such that the nozzle ejects a liquid spirally.

The coating liquid is not limited to the resist agent. It is possible to use another resist agent, an antireflective agent, a low dielectric agent, ferroelectric agent and a solvent for forming a conductive film. These can be applied to deposition using a metal paste as wiring materials.

The number of plates of the divided plate is not limited to three. When higher-precision temperature control is required, it can be set to more than three and a set temperature can be varied as appropriate. Neither the pressure-reducing condition nor the baking condition is limited to the above-described one and they can properly be set according to the conditions of a liquid for use.

The amount of diffusion of liquid can be controlled by an amount of solid matter contained in the liquid, the viscosity or the ejection speed of the liquid, and the moving speed of the substrate or the ejection nozzle.

Various changes and modifications can be made without departing from the scope of the subject matter of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A deposition method comprising:

a liquid film forming step of dropping a liquid, which contains a solvent and solid matter added to the solvent, to a substrate to be processed from a dropping nozzle such that a fixed amount of liquid diffuses on the substrate, and moving the dropping nozzle and the substrate relative to each other with the dropped liquid remaining on the substrate, thereby to form a liquid film extending from a dropping starting point of the substrate to a dropping ending point thereof; and a step of removing the solvent from the liquid film to form a coating film, wherein, in the liquid film forming step, a temperature at a peripheral portion near the dropping starting point of the substrate is controlled to be higher than a temperature at a peripheral portion near the dropping ending point of the substrate.

2. The deposition method according to claim 1, wherein the liquid is one of a resist film agent, an antireflective film agent, a low dielectric film agent, and a ferroelectric film agent.

3. A deposition method according to claim 1, wherein the substrate includes a central portion surrounded by both the peripheral portion near the dropping starting point and the peripheral portion near the dropping ending point, and a temperature at the central portion is controlled to be an intermediate value between the temperature at the peripheral portion near the dropping starting point and the temperature at the peripheral portion near the dropping ending point.

4. A deposition method according to claim 3, wherein the central portion of the substrate is uniform in temperature.

5. A deposition method according to claim 3, wherein a temperature decrease rate as measured from the central portion to the peripheral portion near the dropping ending point is greater than a temperature decrease rate as measured from the peripheral portion near the dropping starting point to the central portion.

6. A deposition method according to claim 1, wherein relative movement between the dropping nozzle and the substrate is defined by movement in a scan direction and movement in a scan pitch direction, which is orthogonal to the scan direction.

7. A deposition method comprising:

a liquid film forming step of dropping a liquid, which contains a solvent and solid matter added to the solvent, to a substrate to be processed from a dropping nozzle such that a fixed amount of liquid diffuses on the substrate, and moving the dropping nozzle and the substrate relative to each other, with the dropped liquid remaining on the substrate, to drop the liquid from a dropping starting point of the substrate to a dropping ending point thereof, thereby to form a liquid film on the substrate; and a step of removing the solvent from the liquid film to form a coating film whose surface is flat, wherein, in the coating film forming step, a temperature at a peripheral portion near the dropping starting point of the substrate is controlled to be higher than a temperature at a peripheral portion near the dropping ending point of the substrate.

8. The deposition method according to claim 7, wherein the liquid is one of a resist film agent, an antireflective film agent, a low dielectric agent, and a ferroelectric film agent.

9. A deposition method according to claim 7, wherein the substrate includes a central portion surrounded by both the peripheral portion near the dropping starting point and the peripheral portion near the dropping ending point, and the substrate is heated or cooled such that a temperature at the central portion is controlled to be an intermediate value between the temperature at the peripheral portion near the dropping starting point and the temperature at the peripheral portion near the dropping ending point.

10. A deposition method according to claim 7, wherein the central portion of the substrate is uniform in temperature.

11. A deposition method according to claim 7, wherein a temperature decrease rate as measured from the central portion to the peripheral portion near the dropping ending point is greater than a temperature decrease rate as measured from the peripheral portion near the dropping starting point to the central portion.

12. A deposition method according to claim 7, wherein relative movement between the dropping nozzle and the substrate is defined by movement in a scan direction and movement in a scan pitch direction, which is orthogonal to the scan direction.

* * * * *

UNITED STATES PATENT AND TRADEMARK OFFICE

CERTIFICATE OF CORRECTION

PATENT NO. : 6,506,453 B2
DATED : January 14, 2003
INVENTOR(S) : Ema et al.

It is certified that error appears in the above-identified patent and that said Letters Patent is hereby corrected as shown below:

Column 12,
Lines 14 and 16, change “claim 7” to -- claim 9 --.

Signed and Sealed this

Twenty-second Day of July, 2003

JAMES E. ROGAN
*Director of the United States Patent and Trademark Office*